US008317590B2

(12) United States Patent
Malle et al.

(10) Patent No.: US 8,317,590 B2
(45) **Date of Patent: *Nov. 27, 2012**

(54) HIGH VOLUME ELECTRONIC LOTTERY TICKET DISTRIBUTION SYSTEM

(75) Inventors: Nimai C. Malle, Austin, TX (US); Joseph R. Enzminger, Austin, TX (US)

(73) Assignee: Multimedia Games, Inc., Austin, TX (US)

( * ) Notice: Subject to any disclaimer, the term of this patent is extended or adjusted under 35 U.S.C. 154(b) by 525 days.

This patent is subject to a terminal disclaimer.

(21) Appl. No.: 12/352,424

(22) Filed: Jan. 12, 2009

(65) Prior Publication Data

US 2009/0124324 A1 May 14, 2009

Related U.S. Application Data

(63) Continuation of application No. 11/026,307, filed on Dec. 30, 2004, now Pat. No. 7,476,152.

(51) Int. Cl.
*A63F 9/24* (2006.01)

(52) U.S. Cl. ..... 463/17; 463/43

(58) Field of Classification Search ..... 463/16–20, 463/29, 40–43; 705/1, 14, 14.3, 500
See application file for complete search history.

(56) References Cited

U.S. PATENT DOCUMENTS 4,494,197 A 1/1985 Troy et al.
4,652,998 A 3/1987 Koza et al.
4,817,951 A 4/1989 Crouch et al.
4,842,278 A 6/1989 Markowicz
5,042,809 A 8/1991 Richardson
5,092,598 A 3/1992 Kamille
5,118,109 A 6/1992 Gumina
5,324,035 A 6/1994 Morris et al.
5,407,199 A 4/1995 Gumina
5,456,465 A 10/1995 Durham
5,595,538 A 1/1997 Haste, III
5,628,684 A 5/1997 Bouedec
5,797,794 A 8/1998 Angell
5,830,067 A 11/1998 Graves et al.
5,868,618 A 2/1999 Netley et al.
5,871,398 A 2/1999 Schneier et al.

(Continued)

OTHER PUBLICATIONS

Appendix X to the State of Washington Class III Gaming Compact, Rules Governing Tribal Lottery Systems, State of Washington (Nov. 13, 1998), 59 pages.*

(Continued)

*Primary Examiner* — Dmitry Suhol
*Assistant Examiner* — Jason Skaarup
(74) *Attorney, Agent, or Firm* — Russell D. Culbertson; JP Cody

(57) ABSTRACT

A game server communicates game record groups to a site controller associated with a gaming site, and the site controller stores the game record groups in associated data storage. The site controller selects one of the stored game record groups in response to a game availability request associated with a respective game presentation, and communicates the selected game record group from the site controller to a player station services controller associated with the gaming site. The player station services controller stores that respective game record group in its associated data storage device and communicates data from a respective game record to a player station in response to a game play request from the player station, thereby allowing the player station to present a player with a lottery game result for the game play request.

16 Claims, 6 Drawing Sheets

U.S. PATENT DOCUMENTS

| | | | | |
|---|---|---|---|---|
| 5,931,468 | A | 8/1999 | Orolin | |
| 5,980,385 | A | 11/1999 | Clapper, Jr. | |
| 6,001,016 | A * | 12/1999 | Walker et al. | 463/42 |
| 6,017,032 | A | 1/2000 | Grippo et al. | |
| 6,024,640 | A | 2/2000 | Walker et al. | |
| 6,082,887 | A | 7/2000 | Feuer et al. | |
| 6,113,492 | A | 9/2000 | Walker et al. | |
| 6,126,542 | A | 10/2000 | Fier | |
| 6,168,521 | B1 | 1/2001 | Luciano et al. | |
| 6,220,961 | B1 | 4/2001 | Keane et al. | |
| 6,241,606 | B1 * | 6/2001 | Riendeau et al. | 463/17 |
| 6,280,328 | B1 | 8/2001 | Holch et al. | |
| 6,358,151 | B1 | 3/2002 | Enzminger et al. | |
| 6,497,408 | B1 * | 12/2002 | Walker et al. | 273/138.1 |
| 6,524,184 | B1 | 2/2003 | Lind et al. | |
| 6,537,150 | B1 | 3/2003 | Luciano et al. | |
| 6,719,631 | B1 * | 4/2004 | Tulley et al. | 463/17 |
| 6,732,916 | B1 * | 5/2004 | Fazzano | 235/375 |
| 6,733,385 | B1 | 5/2004 | Enzminger et al. | |
| 6,802,776 | B2 | 10/2004 | Lind et al. | |
| 6,969,318 | B1 * | 11/2005 | Packes et al. | 463/25 |
| 7,059,966 | B2 | 6/2006 | Luciano, Jr. et al. | |
| 7,625,279 | B1 * | 12/2009 | Luciano et al. | 463/17 |
| 2001/0039204 | A1 | 11/2001 | Tanskanen | |
| 2002/0111214 | A1 * | 8/2002 | Lind et al. | 463/42 |
| 2002/0132666 | A1 * | 9/2002 | Lind et al. | 463/42 |
| 2004/0152499 | A1 | 8/2004 | Lind et al. | |
| 2004/0152508 | A1 | 8/2004 | Lind et al. | |
| 2005/0137010 | A1 | 6/2005 | Enzminger et al. | |

OTHER PUBLICATIONS

Communication pursuant to Article 153(7) EPC dated Apr. 15, 2009 (European Application No. 05821051.9-2221)(5 pages).

* cited by examiner

HIGH VOLUME ELECTRONIC LOTTERY TICKET DISTRIBUTION SYSTEM

CROSS-REFERENCE TO RELATED APPLICATION

This application is a continuation of U.S. patent application Ser. No. 11/026,307 filed Dec. 30, 2004 and entitled "HIGH VOLUME ELECTRONIC LOTTERY TICKET DISTRIBUTION SYSTEM," now U.S. Pat. No. 7,476,152. The Applicants claim the benefit of U.S. patent application Ser. No. 11/026,307 under 35 U.S.C. §120. The entire content of the above-identified U.S. patent application is incorporated herein by this reference.

TECHNICAL FIELD OF THE INVENTION

This invention relates to electronic lottery gaming systems. More particularly, the invention is directed to apparatus, methods, and program products that may accommodate the distribution of electronic lottery tickets from a large number of electronic lottery ticket sets.

BACKGROUND OF THE INVENTION

Video lottery gaming systems use electronic player stations to allow players to purchase lottery tickets and see the results of the purchased lottery tickets. Some of these video lottery systems actually generate the lottery tickets or chances in the game at the individual player stations. Others generate electronic lottery ticket sets at a device remote from the player stations and then transfer electronic tickets to the various player stations in some manner. One particular type of video lottery system stores electronic tickets at a server remote from the individual player stations and transfers an electronic lottery ticket or information from the electronic lottery ticket to a player station only upon receipt of a game play request from the player station. This type of video lottery system is commonly referred to as a "central determinant" lottery system. U.S. Pat. No. 6,733,385 describes one such "central determinant" lottery system.

The lottery ticket server in a central determinant lottery system must keep lottery ticket sets available to satisfy incoming game play requests from the various player stations supported by the lottery ticket server. When only a single lottery game is available in the gaming system and that game uses a single set of electronic lottery tickets, it is a relatively simple matter to store a stock of electronic lottery tickets for that game at the server from which to assign tickets for incoming game play requests. However, some lottery systems offer multiple lottery games and each lottery game may require a different set of lottery tickets. Further, some lottery games require multiple sets of lottery tickets. To accommodate multiple lottery games requiring different lottery ticket sets and/or single lottery games played with multiple ticket sets, the ticket server of the central determinant system must maintain multiple lottery ticket sets available to satisfy incoming game play requests. This task of maintaining lottery ticket set availability becomes more and more burdensome as the number of required electronic lottery tickets sets increases. The problem is exacerbated when a central determinant system supplies electronic lottery tickets for different game providers at a single gaming facility/casino because each game provider may require its own sets of lottery tickets for satisfying game play requests from its player stations. Where the central determinant system must support numerous different lottery games and numerous different game providers, the system must be capable of storing a very large number of electronic ticket sets that must be kept readily available to quickly satisfy game play requests from the various player stations.

SUMMARY OF THE INVENTION

The present invention provides apparatus, methods, and program products for accommodating a high volume of electronic lottery tickets in a central determinant electronic lottery system.

Before summarizing the present invention, it is important to note the terminology that will be used in describing the electronic lottery tickets. As used in this disclosure and the accompanying claims, the data that represents an electronic lottery ticket, or at least that portion of the data representing an electronic lottery that indicates a result associated with the electronic lottery ticket, may be referred to in this disclosure and the accompanying claims as a "game record." It will further be noted that game records may be created in groups referred to as "game record sets" that represent an entire collection of game records for a given lottery game. These game record sets may be subdivided further into smaller groups of game records which may be referred to as "game record subsets." In each case, a group of game records (a "game record group") refers simply to a number of such records whether such records make up an entire game record set for a lottery game or a game record subset for that lottery game.

One method according to the present invention includes storing game record groups at a game server adapted to communicate with a number of gaming sites. The game server communicates two or more of the game record groups to a site controller associated with one of the gaming sites, and the site controller stores the game record groups communicated from the game server. The site controller selects one of the stored game record groups in response to a game availability request associated with a respective game, and communicates the selected game record group from the site controller to a player station services controller associated with the gaming site. The player station services controller stores that respective game record group and communicates data from a respective game record to a player station in response to a game play request from the player station, thereby allowing the player station to present a player with a lottery game result for the game play request.

By employing player station services controllers between the site controller at a given gaming facility and the player stations, game record group handling may be optimized to accommodate very large-volume electronic lottery ticket distribution at the gaming facility from numerous different lottery ticket sets. The player station services controllers can keep only the necessary game record groups readily available, and may store the necessary game record groups in a way to facilitate rapid access. Also, distributing electronic lottery tickets (game records) through player station services controllers allows the system to be readily scalable to accommodate additional games requiring additional electronic lottery ticket sets, that is, additional game record sets.

A system for implementing the above method includes an apparatus having a site controller and a player station services controller. The site controller is associated with a gaming site and is connected to a game server to receive game record groups. Site controller data storage is available at the site controller for storing the received game record groups. The player station services controller of the system is also associated with the gaming site and is connected to the site controller to receive game record groups from the site controller.

The player station services controller includes game service data storage preferably comprising high-speed memory for storing the received game record groups. The player station services controller is also connected to communicate game record data to a player station at the gaming site in response to a game play request from the player station.

The present invention also includes a program product stored on at least one computer readable medium. The program product includes a set of machine-readable instructions that when executed are configured to carry out the methods disclosed herein.

These and other advantages and features of the invention will be apparent from the following description of preferred embodiments, considered along with the accompanying drawings.

DESCRIPTION OF PREFERRED EMBODIMENTS

The present invention may be used with many different types of lottery-type gaming systems. The following description of the present invention will be made in reference to a particular gaming system that will be described below with reference to FIGS. 1 through 3. However, it should be noted that the invention is not limited to any particular lottery-type gaming system configuration. Rather, the invention may be used in connection with any lottery-type gaming system.

Figure 1:
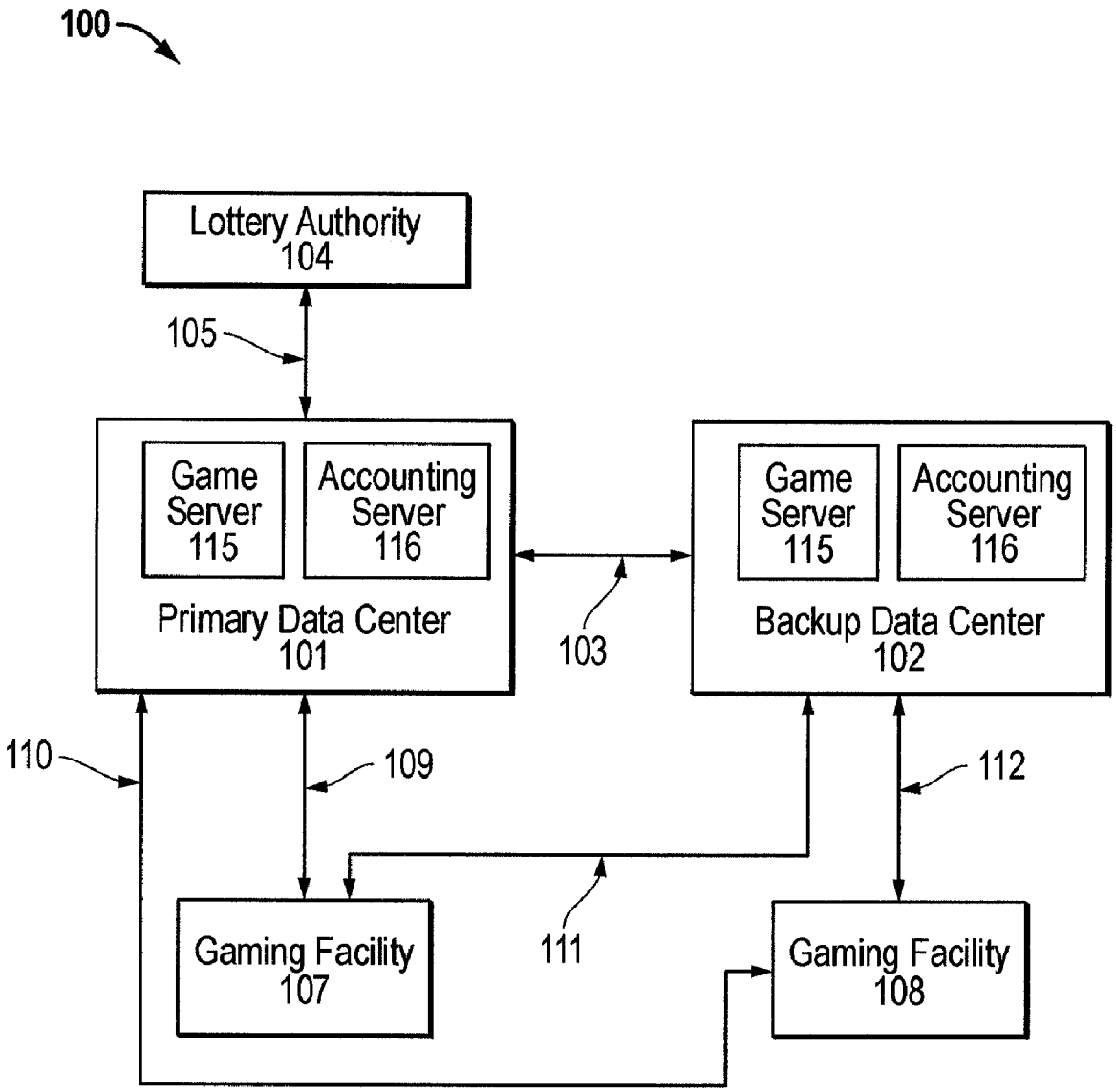
FIG. 1 is a high level diagrammatic representation of a gaming system in which the present invention may be implemented.

Referring to FIG. 1, gaming system 100 includes a primary data center 101 and a backup data center 102 connected by communication link 103. Gaming system 100 also connects to a lottery authority system 104 through communication link 105. The example system 100 is shown with two gaming sites or gaming facilities 107 and 108 where players may participate in lottery games. It will be appreciated, however, that the invention is not limited to two gaming facilities and may include any number of gaming facilities. Gaming facility 107 is connected for communication to primary data center 101 through communication link 109 while gaming facility 108 is connected for communication to the primary data center through communication link 110. Gaming facility 107 is also connected for communication to backup data center 102 through backup communication link 111. Gaming facility 108 is similarly connected to backup data center 102, but through backup communication link 112. It will be appreciated that the invention is not limited to any particular type of communication links between the various elements of the system, provided the communication links can support suitable data transfer rates. It should be noted, however, that gaming system 100 preferably utilizes Internet communications for links 109 and 110. The backup data links 111 and 112 may be through satellite or other wireless communications.

Primary data center 101 and backup data center 102 are essentially identical. Backup data center 102 is included in the system as a fallback or failsafe backup system in the event primary data center 101 goes off line for some reason. Each data center 101 and 102 includes a game server system 115 and an accounting server system 116. As will be described further below, the game server systems 115 may be responsible for producing game record sets according to the invention and may also divide the game record sets into subsets for use at the various gaming facilities. The accounting server systems 116 may collect various system-wide accounting information during lottery games conducted through gaming system 100.

Those skilled in the art of data processing systems and lottery-type systems will appreciate that the data centers 101 and 102 shown in FIG. 1 may commonly include a number of other elements other than the game server system 115 and the accounting server system 116. For example, each data center 101 and 102 may include tape or other backup arrangements, archiving arrangements, management terminals, and switching or other communication arrangements linking the various elements of the respective data center. These details are not necessary for an enabling description of the present invention and are thus omitted from the present disclosure so as not to obscure the present invention in unnecessary detail.

Figure 2:
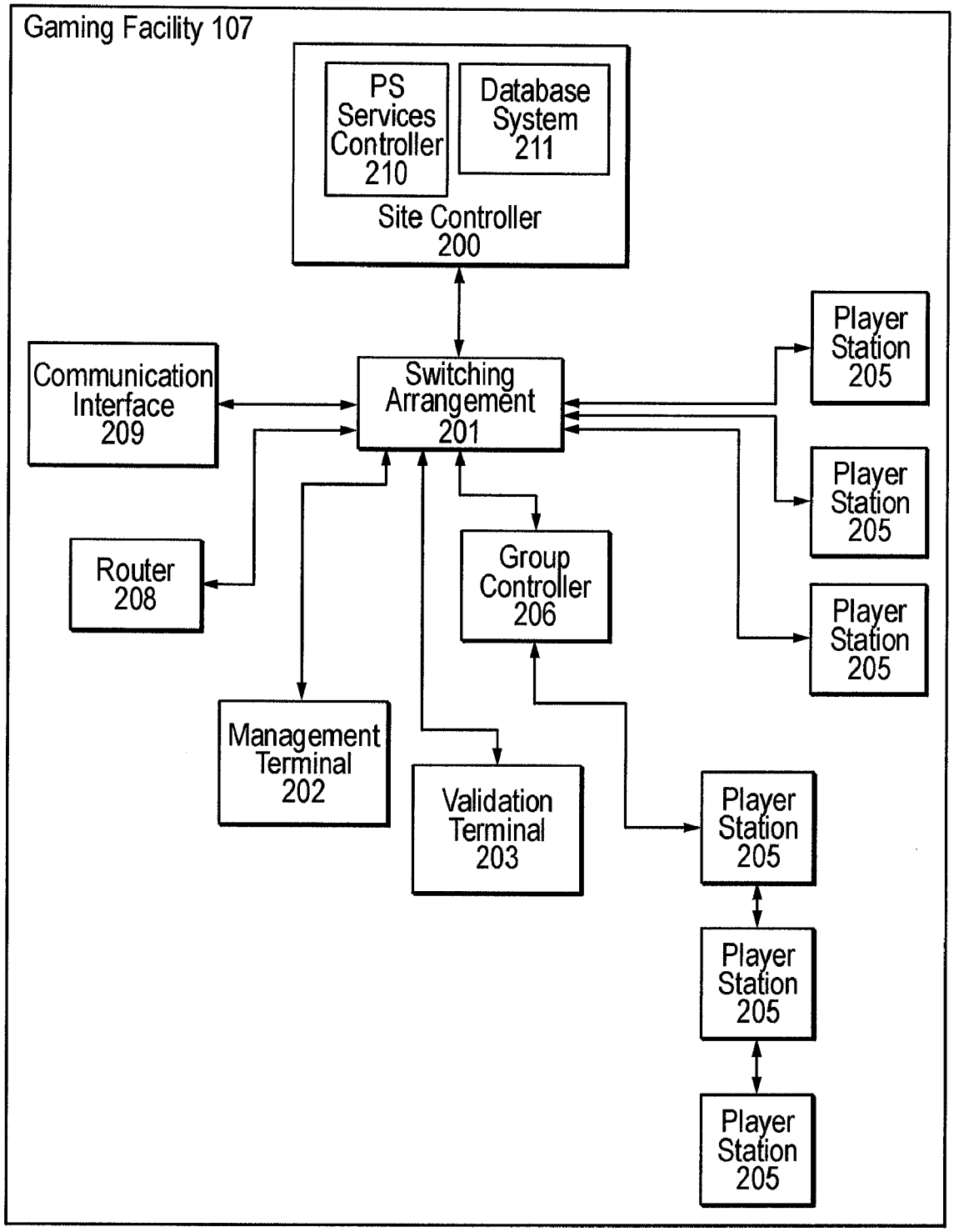
FIG. 2 is a more detailed diagrammatic representation of the gaming facility shown in FIG. 1.

FIG. 2 shows further details of the gaming facility 107 shown in FIG. 1. The gaming facility 107, like the gaming facility 108, includes a site controller 200 connected through a communications or switching arrangement 201 to a number of other elements. The example gaming facility system 107 shown in FIG. 2 includes a management terminal 202, one or more validation terminals 203, and a number of player stations 205. It will be noted that some player stations 205 are connected directly to the switching arrangement 201 such as by a suitable Ethernet networking arrangement while some are connected to the switching arrangement through a group controller 206.

The player stations 205 connected through group controller 206 may be connected together for serial communications under a suitable protocol such as RS-485. Group controller 206 is a suitable controller for implementing the particular communication protocol used by the respective player stations 205 that are connected to the system through the group controller. Management terminal 202 provides an interface to the gaming facility system 107 for management and/or maintenance purposes. Validation terminals 203 may be included to implement a game accounting system and may allow players to redeem gaming system credits for cash or other value and/or allow players to purchase gaming system credit. The example gaming facility system 107 may also include a router 208 and a secondary communication interface 209, both connected to switching arrangement 201. The router 208 provides an interface to a communication arrangement that links the respective gaming facility to the primary data center 101 as shown in FIG. 1. Likewise, secondary communication interface 209 provides an interface to the communication arrangement that is used to provide a communication link with the backup data center 102 shown in FIG. 1.

Player stations 205 each provide a player interface to the gaming facility 107 to allow a player to participate in the various games offered through the system 100. In particular, player stations 205 each allow a player to make a suitable input to cause the player station 205 to produce a game play request which is communicated to the site controller 200.

Each game play request may include a request for a game record in the gaming system 100 and may be associated with a wager amount or bet. Further information on the functions performed by player stations 205 will be described below with reference to FIG. 3.

Site controller 200 is shown in FIG. 2 as including a player station services controller 210 (labeled "PS Services Controller" in the drawings) and a database system 211. Each of these components 210 and 211 may include one or more separate computers or processing devices. Regardless of the particular processing configuration, player station services controller 210 implements player station services and validation terminal services in the preferred system. These services or processes will be described below with reference to FIG. 3. The database system 211 provides database services to support the player station services and validation terminal services and will also be discussed further with reference to FIG. 3.

Figure 3:
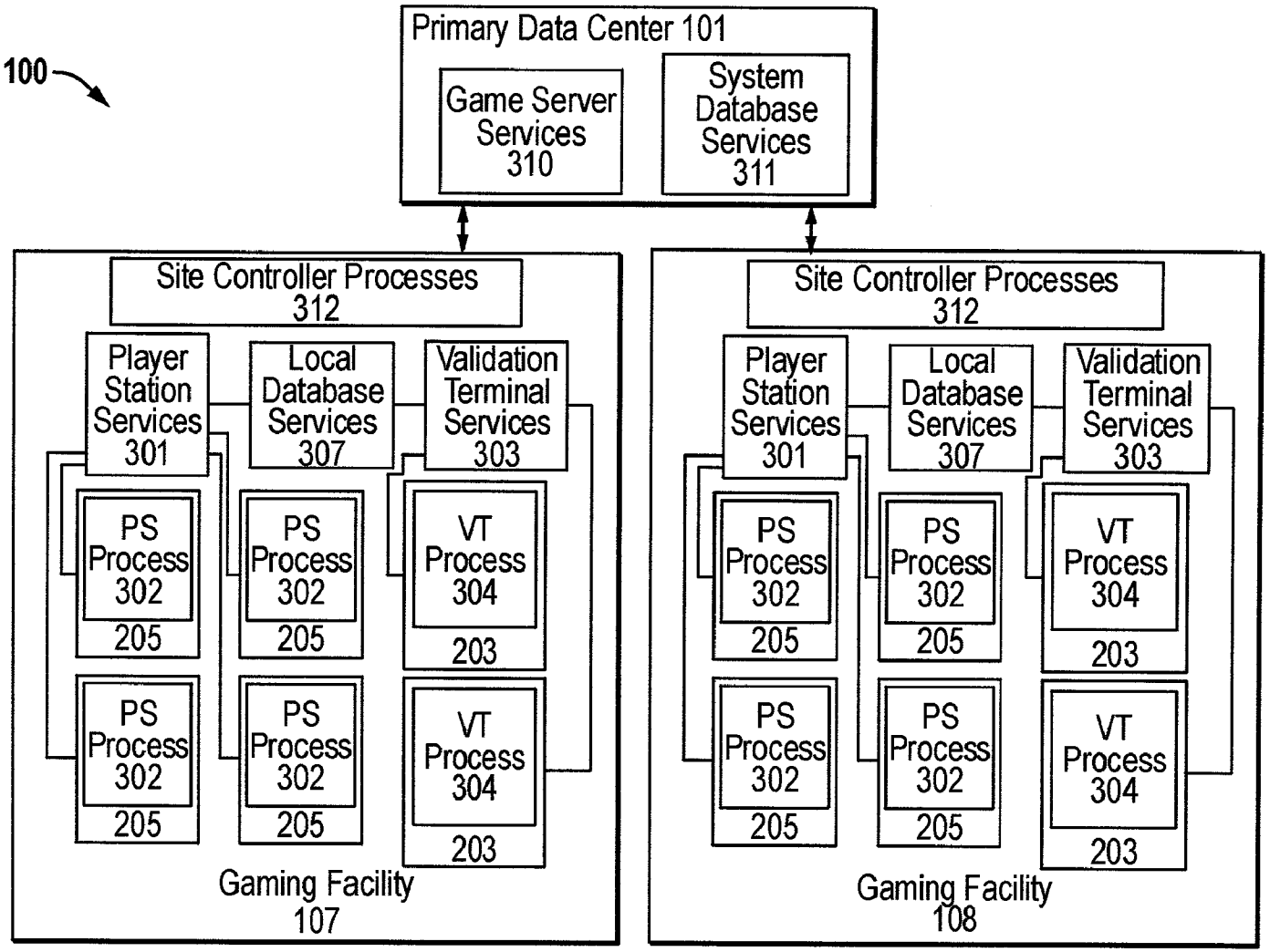
FIG. 3 is a diagrammatic representation showing the cooperation of various services to implement a lottery gaming system embodying the principles of the present invention.

FIG. 3 illustrates certain services, that is, software processes, employed in the illustrated gaming facility 107 of FIGS. 1 and 2. Again, it should be noted that the present invention is not limited to two or any other particular number of gaming facilities. The two gaming facilities 107 and 108 of FIG. 1 are shown only as a simple and convenient example to describe the present invention. As shown in FIG. 3, gaming facility 107 provides player station services 301 to support player station functions or processes 302 at the various player stations 205 included at the gaming facility 107. Validation terminal services 303 provide services to support the various validation terminal processes 304 executed at validation terminals 203 included at the gaming facility 107. As described further below, both the player station services 301 and the validation terminal services 303 rely on a local database service 307 for information such as game play request validity. Gaming facility 108 includes services and processes corresponding to those at the gaming facility 107.

Both gaming facilities 107 and 108 rely on game server services 310 and system database services 311 preferably provided at a data center such as the primary data center 101 in FIG. 1. In particular, the game server services 310 may include processes for generating game record sets, dividing those sets into subsets, and providing the game record sets or subsets (that is, game record groups) to the respective gaming facilities 107 and 108 for local storage. This local storage of game record groups until those records are needed by the player station services is directed by site controller processes 312 in the illustrated system. The operation of site controller processes 312, which are preferably implemented through one or more processing devices of site controller 200 shown in FIG. 2, will be discussed below with reference to FIGS. 5 and 6.

Player station services 301 provide the same functions at their respective gaming facility 107 and 108. Thus, although the following discussion references only gaming facility 107, it will be appreciated that the discussion applies with equal force as to the player station services 301 at gaming facility 108.

Player station services 301 support all functions provided at the respective player stations 205 through the player station processes 302. Player station processes 302 generate a game play request in response to a suitable player input and cause the game play request to be communicated to player station services 301. Player station services 301 may respond to the game play request by performing or directing accounting functions according to the game accounting arrangement used by the gaming system 100 of FIG. 1. If the player is authorized to make the game play request, player station services 301 respond to the game play request by assigning a game record for the request. Player station services 301 also cause sufficient information regarding the game record to be communicated back to player station processes 302 to allow the player station processes 302 to reveal the result of the game record to the player in some suitable fashion. The present invention is not limited to any particular display or arrangement for revealing the result of a game record to the requesting player. Generally, player station processes 302 will cause some graphic to be displayed through which the result is revealed. For example, player station processes 302 may support a reel-type (slot machine-type) graphic, card game graphic, or any other suitable game graphic to reveal results to the player. These graphic arrangements for displaying lottery results to the players may be referred to as game presentations.

Player station services 301 rely on local database services 307 in determining if the particular game play request is valid or appropriate. For example, local database services 307 may keep a confidential player account indicating the number of system credits available to a player or account owner for making wagers. In response to a game play request entered through a particular player station 205 and player station processes 302 executed at the player station 205, player station services 301 may check the data maintained at local database services 307 to make sure the player has sufficient credits to cover the wager associated with the game play request. Player station services 301 may also direct local database services 307 to update the data for the player's account. This player account update may subtract the player's wager associated with the game play request and add any winnings associated with the game record assigned for the game play request.

Validation terminal services 303 provide similar support for validation terminal processes 304 to implement a suitable game accounting system. In particular, validation terminal processes 304 may allow a player to enter a redemption request to redeem gaming system credits for cash. The redemption request may be entered directly by the player or on the player's behalf by a validation terminal attendant. Validation terminal processes 304 executed at the validation terminal (203 in FIG. 2) may cause the redemption request to be communicated to validation terminal services 303 where the redemption request may prompt the validation terminal services 303 to communicate with local database services 307 to obtain information on the gaming system credits then on record for the player or account owner. This gaming system credit value may be communicated back to validation terminal processes 304 to allow the player to redeem the gaming system credit for cash at validation terminal 203 (FIG. 2).

It will be appreciated that player station services 301, validation terminal services 303, and local database services 307 may each include other functions such as additional game accounting functions. Details on these additional functions are omitted from the present disclosure so as not to obscure the present invention in unnecessary detail.

Figure 4:
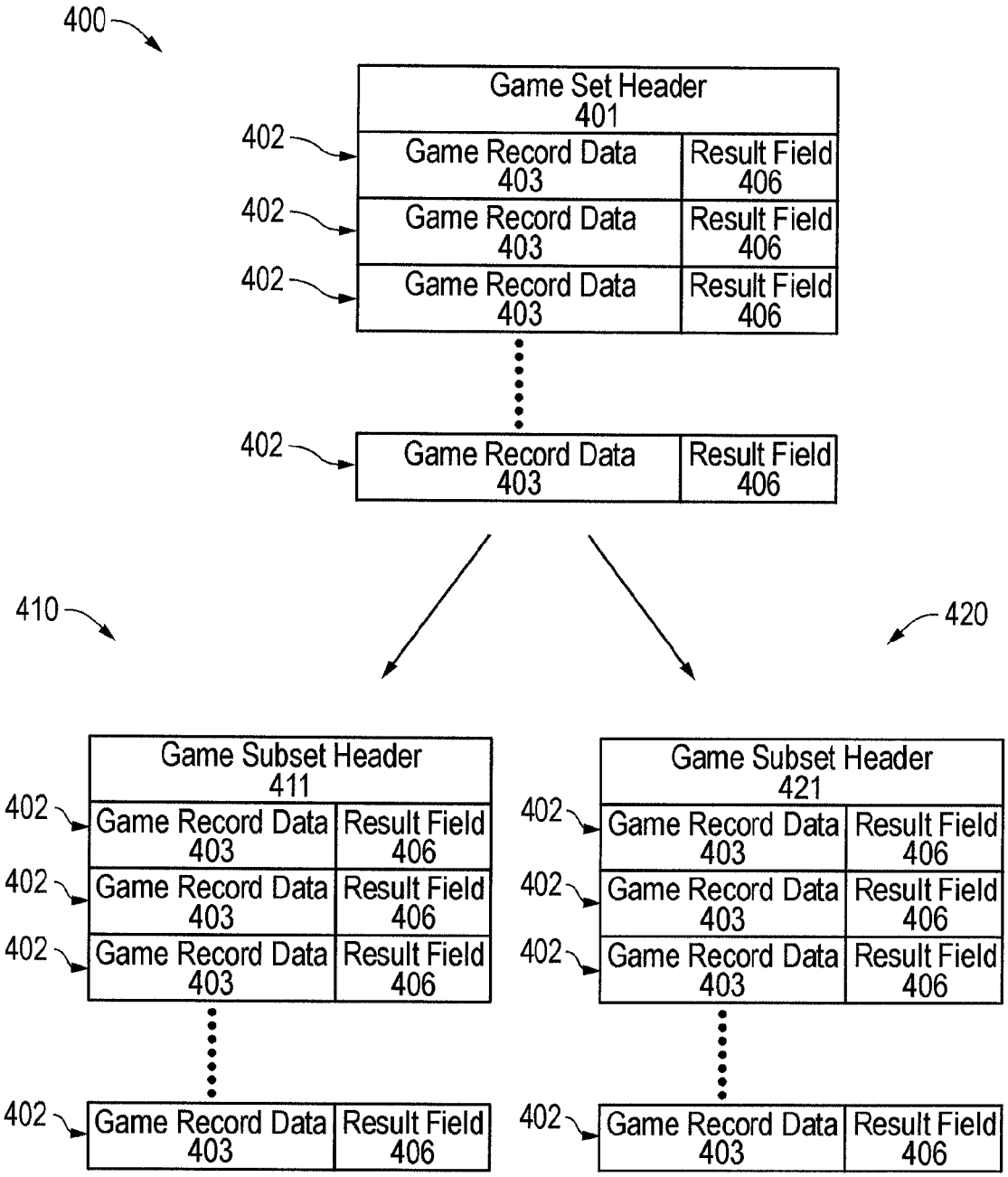
FIG. 4 is a diagrammatic representation of a game record set used in the present invention.

FIG. 4 shows a representation of a game record set 400 that may be used according to principles of the present invention. Game record set 400 comprises a data file preferably including a game set header 401 and a number of individual game records 402. Game record set 400 may include a very large number of game records 402, on the order of many thousand, for example. However, the invention is not limited to any particular number of game records 402 in game record set 400. Each game record 402 includes a field 403 containing game record data. This game record data field 403 preferably identifies the game record 402 and may include additional information such as a result field 406 that indicates the result associated with the respective game record 402. Result field 406 may contain a prize index value, or other suitable indicator of the result associated with the particular game record.

A lottery system using game record set 400 may communicate the entire set at once to a given gaming facility for use in servicing game play requests. However, large game record sets may be divided into smaller game record subsets which are then communicated to various gaming facilities for use in responding to game play requests. Two different game record subsets 410 and 420 are shown in FIG. 4 for purposes of example. Game record subset 410 preferably includes a game subset header 411 and a number of individual game records 402 from the overall game record set 400. Individual game records 402 each include game record data 403 as well as result field 406. Game record subset 420 includes a similar structure with a game subset header 421 and a number of game records 402 divided out from the overall game record set 400 with each game record including the respective game record data 403 and result field 406 for that game record.

Game record sets such as set 400 are created according to particular rules for a game to meet some goal or set of goals. Game record set development rules may call for a certain overall payout and hold, and may also call for a certain win frequency or win frequency at one or more prize levels. Different game rules will produce different odds of obtaining winning game records during the course of play. Generally, each game record set 400 will include a relatively few number of large prize winning records and a relatively larger number of lower prize winning records in addition to a still larger number of losing records that are not associated with any prize.

One preferred gaming system in which the present invention is implemented uses a prize definition file to create game record sets according to the present invention. The prize definition file comprises a prize table having an entry for each different type of prize available in the game record set. Each entry includes a field for a prize index unique to the respective entry, a field for a prize value, and a field for a frequency value for the overall frequency with which the particular prize is to be awarded. The frequency may be expressed in terms of a ratio between the number of times the prize is to be awarded in a given number of game play requests, for example, one in 50,000, one in 1000, or some other ratio.

It will be noted that different game record sets may be considered separate lottery-type games. Some player stations such as those shown at 205 in FIG. 2 may be dedicated to particular game presentations that require game records from a certain type of game record set. Alternatively, certain game presentations available at player stations 205 may use game records from two or more different types of game record sets. Wagers at different levels from a given player station 205 may require game records from different game record sets as well. Thus, it will be appreciated that player station services such as the player station services 301 in FIG. 3 may require access to many different game record sets or game record subsets in order to service the different player stations 205 available at the gaming facility 107. It will also be noted that if the game record sets are divided into subsets and distributed to various gaming facilities or different player station services at a particular gaming facility, the game records will not necessarily be assigned to players in any known order in the overall game record set.

Figure 5:
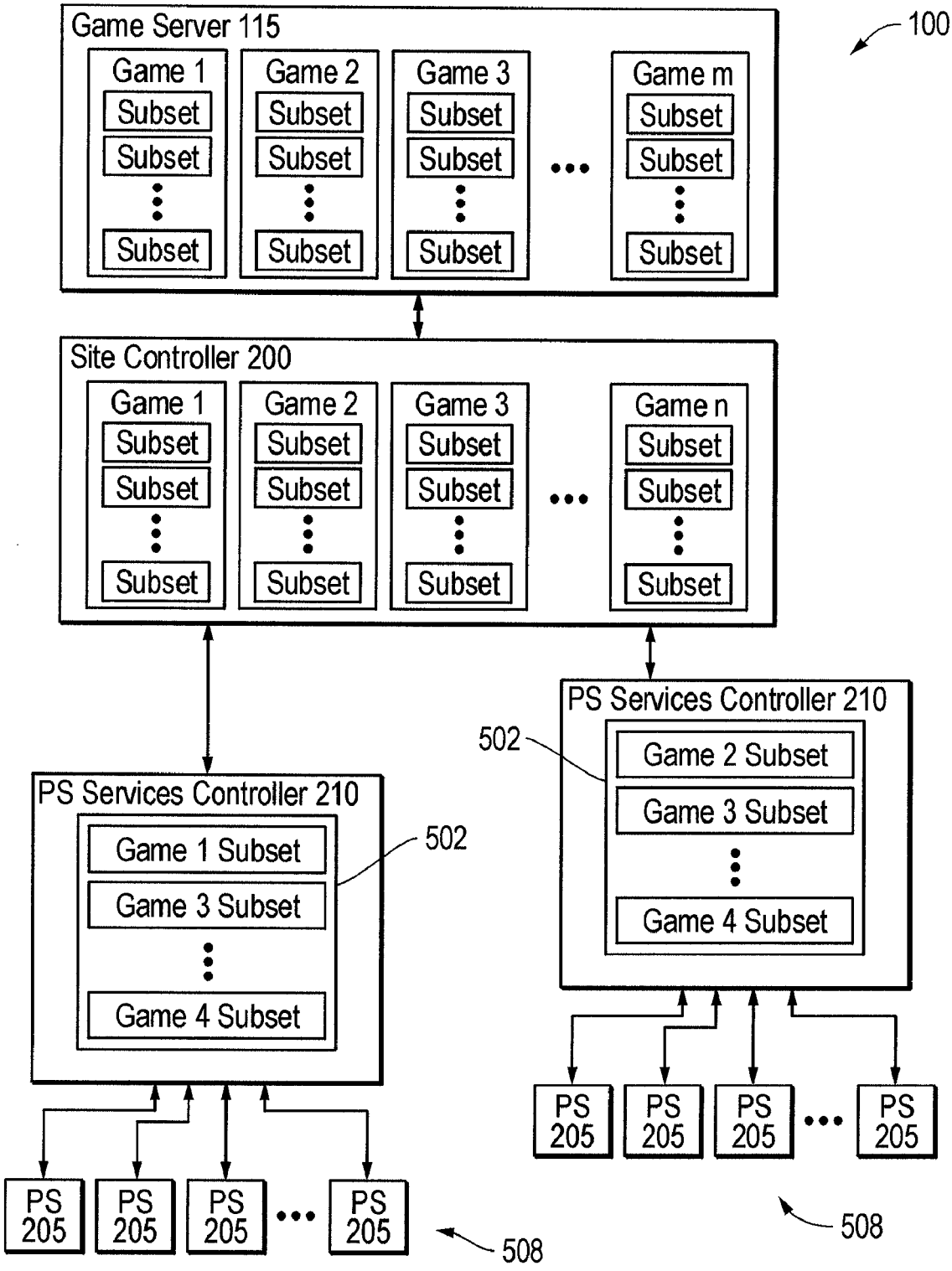
FIG. 5 is a diagrammatic representation of game record group distribution in a gaming system.

FIG. 5 is a diagrammatic representation of game record group distribution in the example gaming system 100 described above with reference to FIGS. 1 and 2. In particular, FIG. 5 shows game server 115, site controller 200, player station services controllers 210, and player stations 205 shown in gaming system 100 of FIGS. 1 and 2. Game record sets such as set 400 of FIG. 4 are illustrated at game server 115 as game 1, game 2, game 3, . . . game m. Each of the game record sets at game server 115 are illustrated being subdivided into a number of game record subsets for each game record set. Game server 115 is illustrated connected for communication with site controller 200. A data storage device associated with site controller 200 stores particular game record set groups from the game record sets at game server 115. These game record groups are shown as particular game record subsets selected from the game record subsets stored at game server 115. FIG. 5 shows site controller 200 as storing particular game record subsets from game 1, game 2, game 3, . . . game n corresponding to those games (game record sets) stored at game server 115.

FIG. 5 also shows site controller 200 being connected for communication with two different player station services controllers 210. Each player station services controller 210 is connected to communicate with a respective group 508 of player stations 205. Each player station services controller 210 also preferably includes high speed memory 502 such as RAM (main system memory of a processing device included in controller 210) for storing game record groups, each preferably comprising a respective game record subset from site controller 200. These game record groups stored at the player station services controllers 210 are used to satisfy game play requests submitted from player stations 205. In the illustrated embodiment of the invention, each player station 205 in a given player station group 508 may submit a game play request to the respective player station services controller 210 with which the group is associated.

Figure 6:
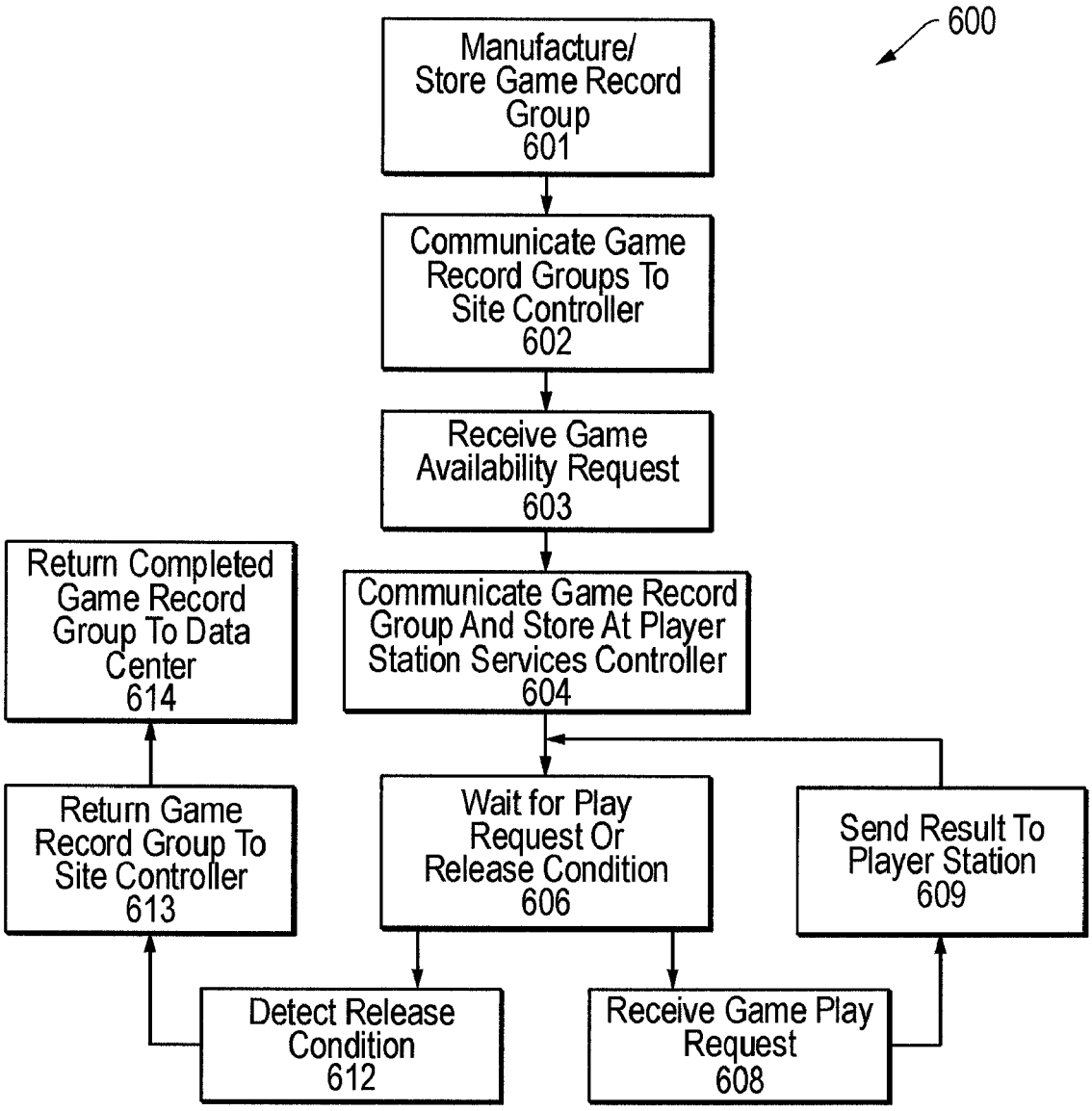
FIG. 6 is a flow diagram illustrating a method according to the present invention.

Methods embodying the principles of the present invention may be described with reference to the flow diagram of FIG. 6 together with the distribution diagram of FIG. 5. It will be appreciated that all of the steps shown in FIG. 6 are preferably performed by the respective components of gaming system 100 shown in FIG. 5 under the control of operational program code. Of course, some forms of the invention may use special purpose processing devices that are configured to perform the indicated steps without operational program code. The invention encompasses the use of gaming systems made up of general purpose processing devices for elements such as game server 115, site controller 200, and player station services controller 210, and gaming systems made up of special purpose processing devices for these elements, and gaming systems which combine general and special purpose processing devices.

The illustrated method in FIG. 6 includes manufacturing and storing game record groups as indicated at process block 601. Game record groups are then communicated to a site controller 200 as indicated at block 602 and preferably held until the site controller receives a game availability request as shown at process block 603. The illustrated method further includes communicating a game record group from site controller 200 to player station services controller 210 and storing the game record group at that controller as shown at process block 604. Once stored at player station services controller 210, the game record group is held pending receipt of a game play request or a release condition as indicated at process block 606 in FIG. 6. When a game play request is received by the player station services controller 210 as indicated at block 608, the player station services controller assigns a game play record from the game record group as shown at process block 609 and sends at least result information to the player station 205 from which the game play request originated. In the event that player station services controller 210 detects a release condition as indicated at process block 612, the player station services controller returns the game record group to the site controller 200 as shown at block 613. Completed game record groups are preferably sent on to some other system component as indicated at process block 614, such as the data center (101 in FIG. 1) from which the game record group originated.

The process step shown at block 601 in FIG. 6 is preferably performed at the game server 115 that is associated with data center 101 shown in FIG. 1. Also, preferred forms of the invention manufacture game record groups in the form of subsets of game records randomly selected from an overall game record set as discussed above with reference to FIG. 4. However, it will be appreciated that the invention is not limited to the game record manufacturing indicated at process block 601. Rather, some forms of the present invention may receive game record groups in the form of game record sets or subsets that have been produced outside of the gaming system. For example, a given lottery system may use game records actually produced by some lottery authority or a third party vendor. In these gaming systems employing the present invention, the game record groups produced by the third party are merely stored in the present system and made available for distribution through the site controller 200 and player station services controller 210 shown in FIG. 5. Regardless of specifically how the game record groups are produced and regardless of whether such groups represent complete sets of game records or subsets of complete sets, the invention includes storing a sufficient number of such game record groups as indicated at block 601 in FIG. 6 to ensure that each gaming facility in the gaming system may quickly receive the game record groups it requires to service game play requests through the player station services controllers 210 included in the system. This may require storing different game record groups for many different types of games (that is, different game presentations) that may be offered through the gaming system.

The communication of game record groups as shown at process block 602 in FIG. 6 may be accomplished in any suitable fashion and using any suitable communications protocols. For example, the communication may be performed over a data link such as that shown at 109 or 110 in FIG. 1 using TCP/IP communications. As described in reference to FIG. 1, the data links used for the communication may be any type that provides the desired data transfer rates. The game record groups are preferably communicated in an encrypted form for security purposes and also a compressed form to facilitate more rapid transfer. A compact compression format such as the BZIP2 format may be used for the game record groups communicated to the respective site controller 200 and for the storing the game record groups at the site controller. Preferably, each site controller 200 in a system according to the present invention stores a sufficient inventory of game record groups to ensure that a game record group is available for any player station services controller 210 that may require it. Depending upon how the system is configured, this may require storing several game record groups of each type that may be available at the given gaming facility. For example, in the arrangement shown in FIG. 5 with two player station site controllers 210, each dedicated to a separate set of player stations 205 that could offer a given game, site controller 200 would preferably store at least two game record groups for each such game. Storing two such game record groups would allow each player station services controller 210 to receive and store a respective game record group at a given time. Site controller 200 may also be configured to store at least one spare or backup game record group of a particular type (from a particular lottery game set) for each player station services controller 210 that could require such a game record group.

It will be appreciated that although the step shown at process block 602 in FIG. 6 refers to game record "groups," that is, more than one game record group, there is no requirement in the present invention that any particular number of game record groups must be communicated to a site controller 200 at any given time. The reference to multiple game record groups being communicated to the site controller 200 in FIG. 6 and in the claims simply reflects the fact that multiple game record groups will be communicated to a given site controller 200 over time, as game records from the various game record groups are used to respond to game play requests from the various player stations.

The present invention encompasses any suitable arrangement for ensuring that the required game record groups are communicated to the various player station services controllers 210. In the preferred form of the invention shown in FIG. 6, a game record group for a given type of game is communicated to the player station services controller 210 after the site controller 200 receives a game availability request as shown at block 603. Such a request may be produced in a number of different ways. A preferred form of the invention generates a game availability request when a player station 205 which requires a given type of game record logs on to the system at a time in which that type of game record is not already stored at the player station services controller 210 serving that player station. Player station log-on in this sense means generally that the player station is placed in some condition in which a player may use the player station to enter a game play request. This log-on preferably occurs when a player station is turned on, but may occur earlier, such as when the player station is first connected in the gaming system or later such as when a player inserts a player account card to enable the player station to receive a wager. For example, at the time of a player station log-on, player station services controller 210 may recognize from the identity of the player station that is logging on that the player station could potentially require game records from game set type X and game records from game set type Y in order to satisfy a given game player request from the player station. In light of this game record requirement information, player station services controller 210 may scan a list of game record types that it currently stores and generate a game availability request to send to the respective site controller 200 upon determining that game records from a game set type X and game records from a game set type Y are not then stored at the player station services controller. This game availability request would identify the type of game records the player station services controller requires, and the site controller 200 would respond by sending at least one game record group to the player station services controller 210 corresponding to each game set type specified in the game availability request.

An example of this interaction between a site controller 200 and a given player station services controller 210 may be described in terms of the example game record groups made up of game record subsets shown in FIG. 5. In this example, let us assume that a player station services controller 210 identifies in some suitable fashion that a player station that is to be serviced by that player station services controller could potentially require game records from game (game set) 2 shown in FIG. 5. In light of this game record requirement, the particular player station services controller 210 may first check in some fashion to see if it currently stores a game record subset from game/game set 2. Upon determining that it does not currently store these types of game records, that is, game records from game/game set 2, the particular player station services controller 210 may communicate to site controller 200 a game availability request for a game record group of that type of game record. That is, the player station services controller 210 requests from the site controller a game record subset from game/game set 2. Once the site controller 200 complies with this game availability request and a game record subset from game/game set 2 is stored at the player station services controller 210, the player station services controller is in condition to satisfy an incoming game play request from the newly logged on player station 205 which requires a game record from game/game set 2. That is, the player station services controller 210 is then in condition to assign a game record from game/game set 2 in response to a game play request from the newly logged on player station 205.

The preferred form of the invention that produces a game availability request at player station log-on also generates such a request any time a given game record group already stored at a player station services controller 210 is running low on unused game records or runs out of unused game records. In either the player station log-on case or the low game record case, the game availability request is preferably generated at a respective player station services controller 210 and communicated to site controller 200. Other preferred forms of the invention may include a suitable component at site controller 200, or elsewhere, to monitor the game record availability and demand at a player station services controller 210, and generate a game availability request as needed to ensure the required game record groups are communicated to the player station services controller to satisfy incoming game play requests from player stations 205. Also, a game availability request may be thought of as originating from a player station 205 such as at player station log-on.

Each player station services controller 210 of FIG. 5 preferably includes sufficient high-speed memory, such as memory 502, to execute any operational program code required to control the functions of the respective player station services controller and to store any game record groups that may be required of it in order to satisfy game play requests originating from the player stations 205 serviced by the player station services controller. Also, in order to minimize the amount of such high-speed memory required, each player station services controller preferably stores game record groups in a compressed data format from which individual game records may be decompressed on a record-by-record basis as game play requests are received. In one preferred implementation of the invention, a fast, low memory overhead compression format such as the ZLIB format may be employed for the game record groups. The compression of a game record group may be performed at the respective site controller 200 before the group is sent to a player station services controller 210, or may be performed at the player station services controller. It will also be appreciated that the game records may be stored in a game record group at a player station services controller 210 in an encrypted format. Thus, each game record may require decryption as it is assigned for a given game play request. This decryption may also be performed either at the player station services controller or the receiving player station.

A gaming system according to the present invention may also employ other techniques to reduce the amount of game record data that must be held in high-speed memory to satisfy incoming game play requests. Dividing large game record sets into smaller subsets is one technique for reducing the amount of the game record data in high-speed memory. Minimizing the amount of data in each game record is another technique to reduce the amount of game record data that must be stored at the player station services controllers 210 in high-speed memory. Each game record stored at a player station services controller 210 according to the present invention may preferably be limited to a record identifier and a result code/index value. The player stations may be configured to act upon the receipt of a result code/index value as described in U.S. Pat. No. 6,733,385. The use of result codes/index values in this fashion not only reduces the amount of data that must be stored at the player station services controllers 210, but also reduces the amount of data that must be communicated to the player stations 205 to send a result to a player station as indicated at process block 609 in FIG. 6.

In order to further minimize the amount of data that must be stored in the preferred high-speed memory at each player station services controller, the present invention includes a process for removing game record groups from the player station services controller 210 during times that it is not necessary to store the game record groups at the player station services controller. The preferred manner of removing unnecessary game record groups from a respective player station services controller 210 involves the release condition detection step as shown at process block 612. A number of different release conditions may indicate that it is not necessary to store a given game record group at a given player station services controller 210 at a given time. For example, a release condition may be defined as a state in which there are no player stations currently logged on to the given player station services controller 210 which require game records from a given game record group. A player station services controller may detect this condition by maintaining a table of logged on player stations and required game record types and comparing the game record type information to the stored game record types. This comparison could be done periodically or after some triggering event such as a player station log off from the gaming system or player station services controller. Another example of a release condition that may be defined according to the invention is a state in which a given game record group stored at a given player station services controller 210 no longer includes any unused game records. This release condition may be used in forms of the invention that maintain each game record group in storage at the respective player station services controller 210 as individual game records are assigned and merely mark the used game records in some fashion as having been used. For example, each game record may include a valid field that holds one value if the game record has not been used, and another value if the game record has been used. This used/unused game record information may also, or alternatively, be incorporated in a separate table stored at the respective player station services controller 210 rather than in each game record in a game record group.

Regardless of the particular release condition detected at block 612 in FIG. 6, once the release condition is detected the respective player station services controller 210 preferably returns the released game record group back to the respective site controller 200 from which it was received. This return step is shown at block 613 in FIG. 6. If the returned game record group includes no further unused game records, the site controller 200 preferably returns the used game record group back to the central manufacturing and storage facility (such as data center 101 in FIG. 1) as shown at block 614 in FIG. 6. However, if a game record group returned to site controller 200 includes further unused game records, or in some forms of the invention, some minimum number of unused game records, the respective site controller preferably holds the partially used game record group. This allows the partially used game record group to be used to respond to a future game availability request designating the type of game records (the particular lottery game) held in that game record group. Considering that the "ownership" of a given game record group for use in satisfying incoming game play requests is temporary, and only maintained at a given player station services controller as needed by that controller, the game record groups may be thought of as being leased out from the respective site controller 200 to a respective player station services controller 210. The player station services controller 210 gives up its "lease" on a given game record group on detection of a release condition as indicated at process block 612 in FIG. 6.

The form of the invention shown in FIG. 5 includes a respective player station services controller 210 for a given group of player stations 205. This particular configuration is preferred for its scalability. However, other preferred forms of the invention may define a different relationship between the player station services controllers 210 and player stations 205. For example, a given player station services controller according to the invention may be accessible by each player station 205 in a gaming facility and may be designated as storing game record groups for a given type of game record. Any player station 205 at the gaming facility requiring that type of game record would then submit its game play request to that specific player station services controller. This alternate arrangement limits the number of game record groups a given player station services controller may be required to store because each player station services controller need not store a different game record group or number of game record groups for each type of player station logged on to the system. This alternate arrangement also reduces the number of game record groups that must be stored at the respective site controller to ensure that a group is available for a given player station services controller. This reduction of game record groups that must be stored at the site controller occurs because only a single player station services controller may require a given type of game record group (that is, a game record group having a given type of game record).

The method steps described above with reference to FIG. 6 may be performed by data processing devices under the control of operational program code. This operational program code represents a program product stored on one or more computer readable devices. The program code may be divided into game server program code executed by a game server such as game server 115 in FIG. 5, site controller program code executed by site controller 200, and player station services program code executed by each respective player station services controller 210.

The game server program code is executable to store a number of game record groups at a central storage device associated with game server 115. The game server program code is also responsible for causing a respective one of the game record groups at the central storage device to be communicated to site controller 200 upon request from the site controller.

The site controller program code is executable to receive the respective game record group communicated to site controller 200 under control of the game server program code and to store the received game record group at data storage associated with the site controller. The site controller program code also causes a respective game record group to be communicated from site controller 200 to a respective one of the player station services controllers 210 upon request from that particular player station services controller.

The player station services program code is preferably executable to receive the game record group communicated under control of the site controller program code and to direct the storage of this received game record group at the high-speed data storage at the player station services controller. The player station services program code is also executable to communicate game record data (the entire game record, or preferably just that part indicating the result of the play) to a player station 205 in response to a game play request from the player station, and to indicate which game records from a group have been used to satisfy respective game play requests.

Either the player station service program code or the site controller program code may be configured to also compress the game record group for storage by the player station services controller 210. Where the game record groups are stored at controller 210 in a compressed format, the player station services program code is also preferably executable to decompress the game records on a record-by-record basis as they are assigned for respective game play requests. Also, either the player station service program code or the site controller program code may be configured to detect release conditions for a game record group at controller 210 and direct the release of the game record group back to site controller 200 and/or back to the game server 115 for archival purposes.

The above described preferred embodiments are intended to illustrate the principles of the invention, but not to limit the scope of the invention. Various other embodiments and modifications to these preferred embodiments may be made by those skilled in the art without departing from the scope of the present invention.

The invention claimed is:

1. A method for making electronic lottery result information available to a player station in an electronic lottery system, the method including:

(a) storing a number of game record groups at a first data storage device of a first data processing device located at a gaming site, each game record group including a number of unused lottery game records of a type required for one or more game presentations provided through a respective player station at the gaming site, and each lottery game record in a respective game record group including result indicating data which indicates a result associated with the respective lottery game record;

(b) in response to a first game availability request for a first game presentation provided through a first player station at the gaming site, selecting a first game record group stored at the first data storage device, communicating the first game record group from the first data storage device to a second data storage device of a second data processing device located at the gaming site but separate from the first player station, and storing the first game record group at the second data storage device, the first game record group including lottery game records of a type required for the first game presentation;

(c) in response to a game play request for the first game presentation provided through the first player station, communicating result indicating data from a respective lottery game record included in the first game record group stored at the second data storage device to the first player station, the game play request being separate from the first game availability request; and (d) communicating the first game record group from the second data storage device to the first data storage device in response to a determination through the electronic lottery system that no game presentation requiring unused lottery game records of the type included in the first game record group is available through a respective player station which is configured to provide game play requests to the second data storage device.

2. The method of claim 1 wherein there are a number of game presentations provided through different player stations at the gaming site, each game presentation requiring lottery game records of at least one lottery game record type, and further including:

(a) maintaining a list in the electronic lottery system of the lottery game record types stored at the second data storage device.

3. The method of claim 2 further including in response to the first game availability request, electronically scanning the list of lottery game record types stored at the second data storage device for the lottery game record type required for the first game presentation, and wherein the first game record group is selected and communicated to the second data storage device upon a determination that the list of lottery game record types does not include the lottery game record type required for the first game presentation.

4. The method of claim 1 further including in response to a subsequent game availability request for lottery game records of the type included in the first game group, communicating the first game record group from the first data storage device to the second data storage device and storing the first game record group at the second data storage device.

5. The method of claim 1 wherein the first game availability request is generated in response to an activation of the first player station in the electronic lottery system.

6. The method of claim 5 wherein the activation of the first player station occurs when the player station first becomes available for play in the electronic lottery system.

7. An apparatus for making electronic lottery result information available to a player station in an electronic lottery system, the apparatus including:

(a) a site controller and associated site controller data storage device located at a gaming site, the site controller data storage device storing a number of game record groups wherein each game record group includes a number of unused lottery game records of a type required for one or more game presentations provided through a respective player station at the gaming site, and each lottery game record in a respective game record group includes result indicating data which indicates a result associated with the respective lottery game record; and (b) a player station services controller and associated player station data storage device located at the gaming site and being separate from a first player station providing a first game presentation at the gaming site, the player station services controller for (i) receiving a first game record group from the site controller data storage device responsive to a first game availability request for the first game presentation, the first game record group including lottery game records of a type required for the first game presentation, for (ii) storing the first game record group at the player station services data storage device, for (iii) communicating the result indicating data for a respective one of the lottery game records in the first game record group to the first player station in response to a game play request from the first player station, the game play request being separate from the game availability request, and for (iv) communicating the first game record group from the player station services data storage device to the site controller data storage device in response to a determination through the site controller that no game presentation requiring unused lottery game records of the type included in the first game record group is available through a respective player station which is configured to provide game play requests to the player station services data storage device.

8. The apparatus of claim 7 wherein there are a number of game presentations provided through different player stations at the gaming site, each game presentation requiring lottery game records of at least one lottery game record type, and wherein the site controller maintains a list of the lottery game record types stored at the player station services data storage device.

9. The apparatus of claim 8 wherein the player station services controller is also for, in response to the first game availability request, scanning the list of lottery game record types stored at the player station services data storage device for the lottery game record type required for the first game presentation, and wherein the first game record group is selected and communicated to the player station services data storage device upon a determination that the list of lottery game record types does not include the lottery game record type required for the first game presentation.

10. The apparatus of claim 7 wherein the site controller is also for, in response to a subsequent game availability request for lottery game records of the type included in the first game record group, communicating the first game record group from the site controller data storage device to the player station services data storage device and storing the first game record group at the player station services data storage device.

11. The apparatus of claim 7 wherein the first game availability request is generated in response to an activation of the first player station in the electronic lottery system.

12. The apparatus of claim 11 wherein the activation of the first player station occurs when the player station first becomes available for play in the electronic lottery system.

13. A program product stored on one or more non-transitory computer readable devices, the program product including:

(a) site controller program code being executable for storing a number of game record groups at a first data storage device of a first data processing device located at a gaming site, each game record group including a number of unused lottery game records of a type required for one or more game presentations provided through a respective player station at the gaming site, and each lottery game record in a respective game record group including result indicating data which indicates a result associated with the respective lottery game record; and (b) player station services program code being executable for (i) receiving a first game record group from the first data storage device responsive to a first game availability request for the first game presentation provided through a first player station at the gaming site, the first game record group including lottery game records of a type required for the first game presentation, for (ii) storing the first game record group at a second data storage device at the gaming site separate from the first player station, for (iii) communicating the result indicating data for a respective one of the lottery game records in the first game record group from the second data storage device to the first player station in response to a game play request from the first player station, the game play request being separate from the game availability request, and for (iv) communicating the first game record group from the second data storage device to the first data storage device in response to a determination through the site controller program code that no game presentation requiring unused lottery game records of the type included in the first game record group is available through a respective player station which is configured to provide game play requests to the second data storage device.

14. The program product of claim 13 wherein there are a number of game presentations provided through different player stations at the gaming site, each game presentation requiring lottery game records of at least one lottery game record type, and wherein the site controller program code is also executable for maintaining a list of the lottery game record types stored at the second data storage device.

15. The program product of claim 14 wherein the player station services program code is also executable for, in response to the first game availability request, scanning the list of lottery game record types stored at the second data storage device for the lottery game record type required for the first game presentation, and wherein the first game record group is selected and communicated to the second data storage device upon a determination that the list of lottery game record types does not include the lottery game record type required for the first game presentation.

16. The program product of claim 13 wherein the site controller program code is also executable for, in response to a subsequent game availability request for lottery game records of the type included in the first game record group, communicating the first game record group from the first data storage device to the second data storage device and storing the first game record group at the second data storage device.

* * * * *